US006263639B1

(12) United States Patent
Kim

(10) Patent No.: US 6,263,639 B1
(45) Date of Patent: Jul. 24, 2001

(54) DROPPING APPARATUS FOR AUTOMATIC TABLET SORTING AND COUNTING MACHINE

(76) Inventor: Jin S. Kim, 100-23, Galsandong, Dalsuhgu, Taegu (KR)

( * ) Notice: Subject to any disclaimer, the term of this patent is extended or adjusted under 35 U.S.C. 154(b) by 0 days.

(21) Appl. No.: 09/716,111

(22) Filed: Nov. 20, 2000

Related U.S. Application Data

(63) Continuation of application No. 09/365,062, filed on Jul. 30, 1999, now Pat. No. 6,202,385.

(30) Foreign Application Priority Data

Jul. 29, 1998 (KR) ..... 98-14638

(51) Int. Cl.[7] ..... B65B 35/54
(52) U.S. Cl. ..... 53/154; 53/168
(58) Field of Search ..... 53/411, 154, 155, 53/168, 131.5

(56) References Cited

U.S. PATENT DOCUMENTS 5,787,678 * 8/1998 Koike et al. ..... 53/154
5,839,257 * 11/1998 Soderstrom et al. ..... 53/131.5
5,946,883 * 9/1999 Yuyama et al. ..... 53/154

* cited by examiner

*Primary Examiner*—Peter Vo
*Assistant Examiner*—Nathaniel Chukwurah
(74) *Attorney, Agent, or Firm*—John K. Park; Park & Sutton LLP

(57) ABSTRACT

An automatic tablet dispenser comprising a tablet dropping unit having a first drum body, a second drum body, a means for rotating the first and second drum bodies and a packaging unit disposed below the tablet dropping unit to package tablets released through the tablet release holes from the tablet dropping unit and discharge packaged tablet bags to an exterior of the automatic tablet dispenser. The first and second drum bodies are closedly looped by first and second arc-shaped outer drums and inner drums. Tablet cassettes form an outer periphery of said each drum, and the drum rotating means allows the tablet cassettes to be filled with tablets when required. Tablet release holes are downwardly formed in each of the drums by tablet release guides to correspondingly communicate with the tablet cassettes for the tablet release.

20 Claims, 4 Drawing Sheets

DROPPING APPARATUS FOR AUTOMATIC TABLET SORTING AND COUNTING MACHINE

RELATED APPLICATION AND CLAIMING THE FOREIGN PRIORITY

This is a continuation application of U.S. patent application Ser. No. 09/365,062 filed Jul. 30, 1999 now U.S. Pat. No. 6,202,385, of which the applicant has claimed and requested a foreign priority, through Paris Convention, based on a patent application filed in the Republic of Korea (South Korea) with the filing date of Jul. 29, 1998 and Korean application number 1998-14638. (See the attached declaration.)

BACKGROUND OF THE INVENTION

1. Field of Invention

The present invention relates to a tablet dispensing system, and more specifically to an improved tablet dropping unit for an automatic tablet dispensing system which guides the dropping of tablets released from respective tablet cassettes to a tablet packaging unit therebelow based upon information input in the automatic tablet dispensing system.

2. Description of the Prior Art

Generally, automatic tablet dispensers are employed in hospitals and drugstores to automate the output and assembly of corresponding tablets when the prescription is input into a computer while also serving to dispense the per-dosage assembled tablets.

Such an automatic tablet dispensing system includes: a main computer for enabling an appropriate prescription on the basis of proper medicine, intake method, daily intake frequency and intake duration depending upon each patient; a tablet dropping unit having a plurality of tablet cassettes and a drum for storing therein and releasing therefrom the tablets in correspondence to the prescription set up in the computer; and a packaging unit disposed below the tablet dropping unit and serving to package the output tablets and releasing the same to an exterior of the automatic tablet dispenser.

The packaging unit is made up of: a release hopper for assembling the tablets being dropped from the tablet drop unit; a heater assembly for packaging the tablets being discharged through the release hopper; a printer for printing respective information on packaging paper; and a release conveyer for externally discharging the medicine bags containing tablets. Essentially, the tablet dropping unit serves to guide the tablets released from respective tablet cassettes to the packaging unit therebelow on the basis of information input in the main computer.

Such a tablet dropping unit is provided above the packaging unit in a cylindrical drum type and rotated by a motor disposed at an upper portion thereof, and also a guide roller disposed at a lower portion thereof enables its stable rotation.

A plurality of tablet cassettes storing therein a certain amount of tablets are attached onto and along the outer periphery of the drum. The tablets in the tablets cassettes are transferred through release holes of the drum into the packaging unit. The single drum type tablet dropping unit has developed into a double drum type having an inner drum and an outer drum to increase tablet cassette mounting capacity.

However, the double drum type of tablet dropping unit according to the conventional art have disadvantages in that:

(1) a wire arrangement to control the respective tablets cassettes can become complicated with inevitable tangling;

(2) severe noise and consequent error may occur during operation due to the complicated wiring, thereby hindering an accurate release of tablets; and (3) maintenance cost may increase with breakdown and cassette replacement resulting from the complicated wiring.

Furthermore, the linearly provided release holes may delay the tablet dropping and cause the tablets to flow into other tablet cassettes, thereby deteriorating smooth packaging operation in the packaging unit. That is, the tablet dropping is delayed such that the tablets being dropped from the tablet cassettes mounted on an upper portion of the drum may take a longer time period to reach the lower portion thereof since the dropping tablets may hit against the inner periphery of the drum instead of dropping through the central shaft of the drum.

SUMMARY OF THE INVENTION

The present invention is contrived to overcome the conventional disadvantages. Therefore, it is an object of the present invention to provide an automatic tablet dispensing system which provides two separated drum bodies each closedly looped and faced against each other. Another object is to provide a tablet dropping unit for an automatic tablet dispensing system, capable of mounting a larger quantity of tablet cassettes on the improved drum while further facilitating the tablet dropping operation.

To achieve the above-described objects, an automatic tablet dispenser according to the present invention comprises a tablet dropping unit having a first drum body, a second drum body and a means for rotating the first and second drum bodies. The first drum body is closedly looped by a first arc-shaped outer drum and a first inner drum each incorporating the first drum body, and the second drum body is closedly looped by a second arc-shaped outer drum and a second inner drum each incorporating the second drum body. A plurality of tablet cassettes for storing therein and releasing therefrom a predetermined amount of tablets form an outer periphery of said each drum.

The drum rotating means allows the tablet cassettes to be filled with tablets when required, and a plurality of tablet release holes are downwardly formed in said each drum by a plurality of tablet release guides to correspondingly communicate with the tablet cassettes for the tablet release. For a better performance, the automatic tablet dispenser may further comprise a packaging unit disposed below the tablet dropping unit to package tablets released through the tablet release holes from the tablet dropping unit and discharge packaged tablet bags to an exterior of the automatic tablet dispenser.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

With reference to the accompanying drawings, the present invention will now be described.

Figure 1:
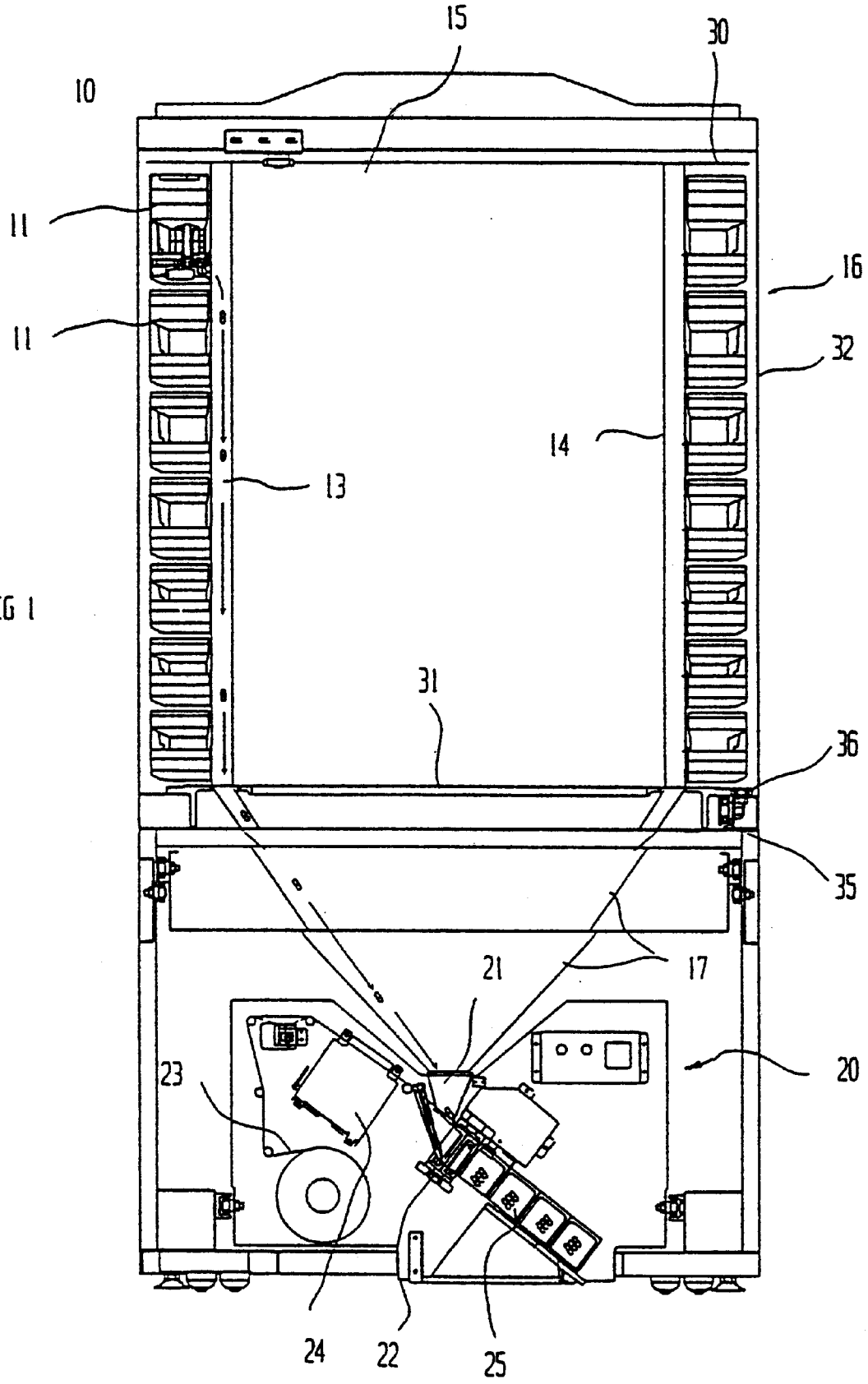
FIG. 1 is a front view illustrating a conventional single drum automatic tablet dispensing system with a front panel removed to show the inner components.

As shown in FIG. 1, a conventional automatic tablet dispenser 10 includes a tablet dropping unit 16 having a cylindrical drum unit 15 with release holes 13, 14 engaged thereto so as to communicate with a plurality of tablet cassettes 11. The tablet cassettes 11 respectively store therein tablets and release a measured quantity of tablet therefrom into corresponding release holes 13, 14, so that the tablets released from the tablet cassettes 11 fall through the release holes 13, 14.

Below the tablet dropping unit 16 there is provided a guide hopper 17 for safely guiding the tablets being released through the release holes 13, 14 so that the tablets may not be dispersed.

A packaging unit 20 is disposed below the guide hopper 17 to package and discharge the released tablets outside the automatic tablet dispenser 10. The packaging unit 20 includes a release hopper 21 for gathering the tablets dropped from the tablet dropping unit 16, a heater assembly 22 for packaging the tablets released through the release hopper 21, a printer 24 for printing respective information on the packaging paper 23, and a discharge conveyer 25 for externally releasing respective tablet-packaged bags.

The automatic tablet dispenser 10 is controlled by the main computer (not shown) which is informed of an appropriate prescription for a target patient which can include proper medicine, intake method, daily intake frequency, and intake duration.

Figure 2:
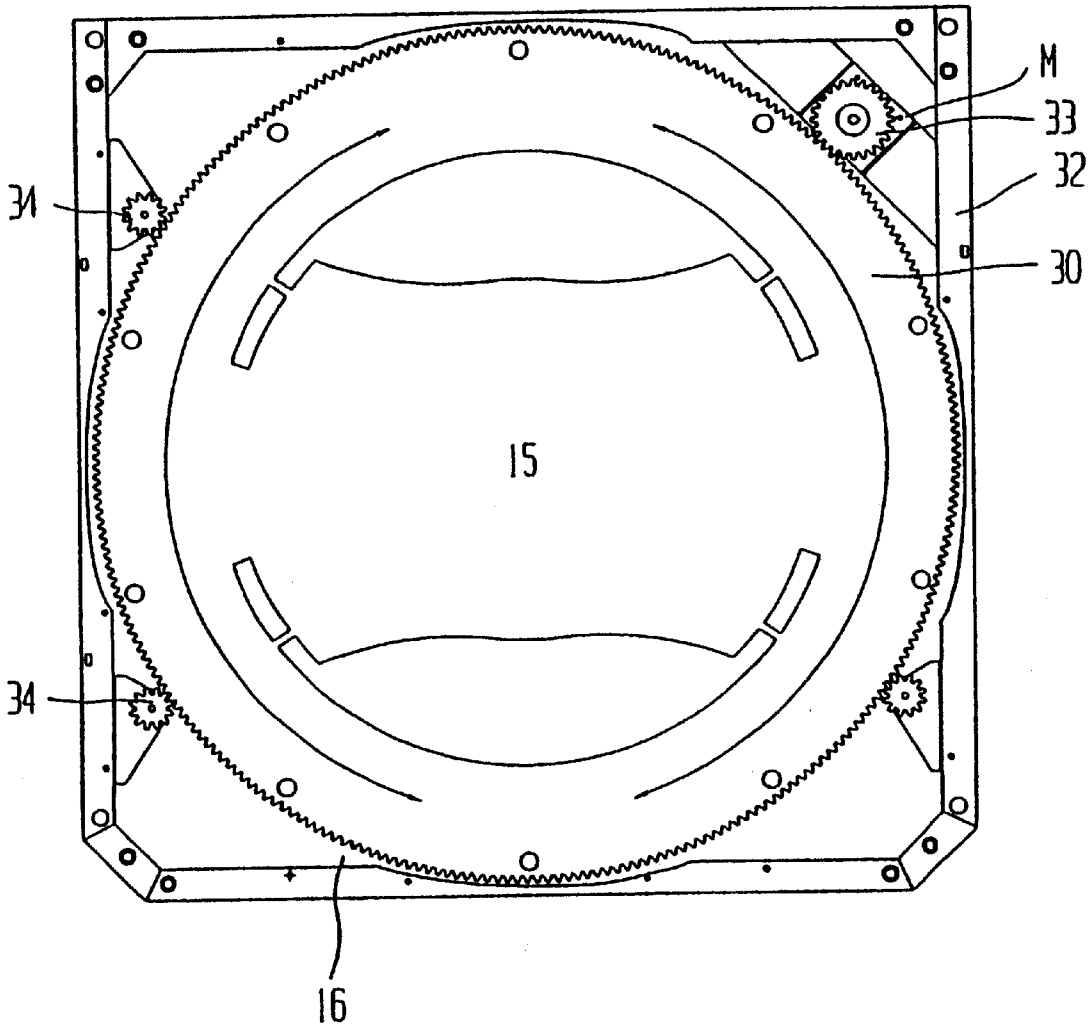
FIG. 2 is a schematic plan view illustrating a driving member of the automatic tablet dispensing system according to the present invention.
Figure 3:
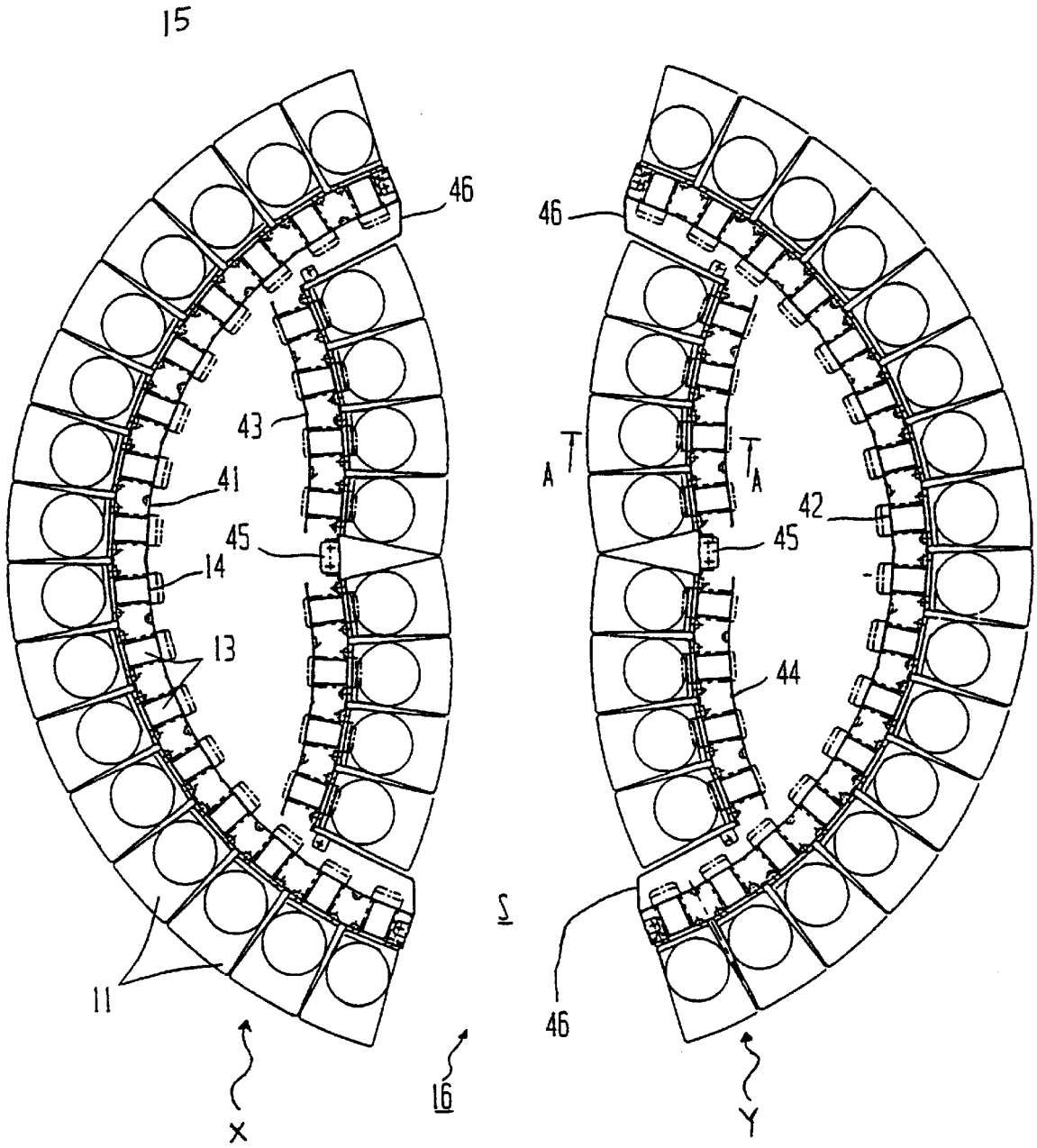
FIG. 3 is a cross-sectional plan view illustrating a tablet dropping unit of the automatic tablet dispensing system according to the present invention.
Figure 4:
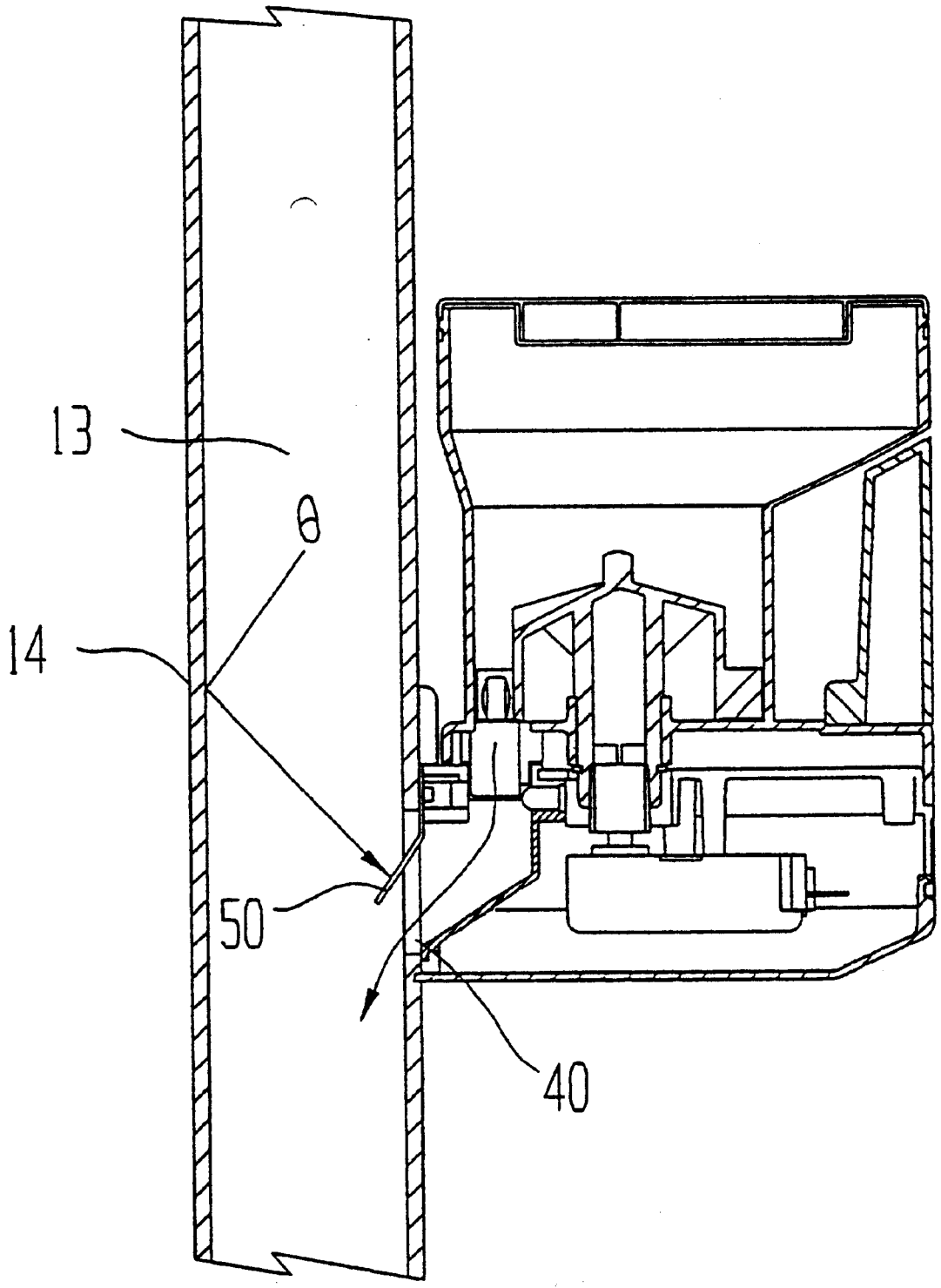
FIG. 4 is a cross-sectional view taken along line A—A of FIG. 3.

The tablet dropping unit 16 according to the present invention is illustrated in FIGS. 2 through 4. The tablet dropping unit 16 is operably supported by a gear plate 30 fixed on top of a pair of drum bodies X, Y and by a guide plate 31 (shown in FIG. 1) fixed beneath the drum bodies X, Y. The gear plate 30 is provided such that it rotates in a clockwise or counterclockwise direction in combination with a driving gear 33 fixed to a motor M fixedly attached to a body case 32 and a plurality of auxiliary gears 34 provided along the periphery of the gear plate 30.

The guide plate 31 fixed beneath the lower bottom of the drum bodies X, Y is disposed to desirably rotate in correspondence to a plurality of guide rollers 35, 36 which are respectively fixed to the body case 32.

The present invention provides an improved construction of the drum unit 15 into drum bodies X, Y in the tablet dropping unit 16 and an improved release hole 13 formed within the release guide 14 of the drum bodies X, Y, thereby enabling a larger number of tablet cassettes 11 to be mounted along the drum bodies X, Y as well as facilitating a smooth tablet dropping. As shown in FIG. 4, a release opening 40 is formed through the wall of the release guide 14 at a point of attachment with each individual tablet cassette 11 to facilitate the release of tablets therethrough. The release guide 14 is provided to form a pair of drum bodies X, Y of the tablet dropping unit 16.

As shown in FIG. 3, each of the drum bodies X, Y is closedly looped by a combination of the arc-shaped left drum 41 and a left pair of auxiliary drums 43 and by another combination of the arc-shaped right drum 42 and a right pair of auxiliary drums 44. The drum bodies X, Y are defined by a predetermined space S therebetween.

The left and right pairs of auxiliary drums 43, 44 may be arc-shaped in formation. The left auxiliary drum pair 43 is linearly aligned so as to closedly loop the connection of left drum 41 and the left auxiliary drum pair 43. In the same manner, the right auxiliary drum pair 44 is also linearly aligned to closedly loop the connection of the right drum 42 and the right auxiliry drum pair 44. In this construction, the tablet cassettes 11 of the first auxiliary drum pair 43 are distanced by the space S from and faced against the corresponding tablet cassettes 11 of the second auxiliary drum pair 44. Selectively, a connection fragment 45 may be provided to engage the auxiliary drum pair 43, 44 respectively therebetween.

Each end of the connected arc-shaped auxiliary drum pairs 43, 44 are fixed to corresponding ends of the left and right arc-shaped drums 41, 42 using a bracket 46, thereby forming the whole drum bodies X, Y. That is, the left arc-shaped drum 41 and the first auxiliary drum pair 41 are closedly looped to each other and fastened by the bracket 46 while incorporating the left drum body X, and in a corresponding manner the right arc-shaped drum 42 and the second auxiliary drum pair 44 are closedly looped to each other and fastened by the bracket 46 while incorporating the right drum body Y.

Referring to FIG. 4, a guide plate 50 formed on the release guide 14 slants downward from above each release opening 40 so as to prevent tablets being dropped through the release hole 13 from flowing into the release opening 40. Here, the release opening 40 formed through the wall of the release guide 14 serves to guide the tablets being dropped from a target tablet cassette 11 into the release hole 13. The guide plate 50 is preferably formed of a thin film, such as PE film, which is sufficiently elastic so as not to damage the tablets being dropped thereon.

As described above, the present invention enables a large number of tablets cassettes 11 to be mounted onto the outer periphery of the release guides 14 of the drum bodies X, Y. That is, when the prescription is input in a main computer, the tablets contained in the respective tablet cassettes 11 are released by a known driving device, and the released tablets are flowed through the release opening 40 formed along the release guide 14 into the release hole 12 and down to the packaging unit 20.

The tablets dropped into the packaging unit 20 are packed with one-dosage quantity in combination with the release hopper 21, the packaging paper 23, the heater assembly 22 and the printer 24. Then, the per-dosage packaged envelopes are externally discharged by a release conveyer 25. Such serial operations are identical to those of the conventional art and accordingly detailed description will be omitted. Instead, the tablet dropping unit 16 will be explained in further detail.

Specifically, tablets released from the tablet cassettes 11 may hit along the inner walls of the release hole 13 and flow into other release openings 40 accordingly, such disadvantages are overcome by the guide plate 50 which serves to prevent the dropping tablets from flowing into other release openings 40.

In the present invention, the drum bodies X, Y of the tablet dropping unit 16 are respectively looped in formation, thereby realizing a smoother tablet dispensing operation while maintaining tablet cassette mounting capacity equivalent to that of a conventional twofold drum system.

In addition, the predetermined space S secured between the drum bodies X, Y allows an operator convenient and easy access to the auxiliary drums 43, 44 and to the left and right drums 41, 42 to replace and maintain the tablet cassettes 11 therebetween. Also, any circuit wires are advantageously gathered through respective holes formed by the left drum 41 and the corresponding auxiliary drum 43 and by the right drum 42 and the corresponding auxiliary drum 44. This substantially overcomes the conventional wiring disadvantage of the conventional twofold drum system by which circuit wires are rendered to constant tangling with each other caused by the reverse rotation of dual concentric drum systems.

As discussed above, the tablet dropping unit for an automatic tablet dispensing system according to the present invention improves the conventional drum and the tablet release openings of the release holes, thereby accomplishing a smoother tablet dropping operation as well as realizing a large quantity of tablet cassette mounting.

What is claimed is:

1. An automatic tablet dispenser, comprising:

a) a tablet dropping unit having a first drum body and a second drum body, wherein the first drum body is closedly looped by a first arc-shaped outer drum and a first inner drum each incorporating the first drum body, wherein the second drum body is closedly looped by a second arc-shaped outer drum and a second inner drum each incorporating the second drum body, wherein a plurality of tablet cassettes for storing therein and releasing therefrom a predetermined amount of tablets form an outer periphery of said each drum, wherein a plurality of tablet release holes are downwardly formed in said each drum by a plurality of tablet release guides to correspondingly communicate with the tablet cassettes for the tablet release; and b) a packaging unit disposed below the tablet dropping unit to package tablets released through the tablet release holes from the tablet dropping unit and discharge packaged tablet bags to an exterior of the automatic tablet dispenser.

2. The automatic tablet dispenser of claim 1, wherein the packaging unit comprises:

a) a discharge hopper for assembling the tablets being dropped from said tablet dropping unit;

b) a heater assembly for packaging the tablets released through the discharge hopper;

c) a printer for printing respective information on a packaging paper; and d) a release conveyer for externally releasing the tablet-packaged bags.

3. The automatic tablet dispenser of claim 1, wherein the first and second inner drums are respectively arc-shaped.

4. The automatic tablet dispenser of claim 3, wherein the first and second arc-shaped inner drums are respectively formed in a linearly aligned pair such that the first drum body is closedly looped by the first arc-shaped outer drum and the first arc-shaped inner drum pair and that the second drum body is closedly looped by the second arc-shaped outer drum and the second arc-shaped inner drum pair.

5. The automatic tablet dispenser of claim 1, wherein a plurality of tablet release openings are formed through the tablet release guides so that the tablets in the tablet cassettes are selectively released through the tablet release openings, wherein a guide plate is formed above said each tablet release opening and correspondingly on said each release guide in a downward slant to prevent tablets being dropped through said release hole from flowing into said tablet release opening.

6. An automatic tablet dispenser, comprising:

a) a tablet dropping unit having a first drum body, a second drum body and a means for rotating the first and second drum bodies, wherein the first drum body is closedly looped by a first arc-shaped outer drum and a first inner drum each incorporating the first drum body, wherein the second drum body is closedly looped by a second arc-shaped outer drum and a second inner drum each incorporating the second drum body, wherein a plurality of tablet cassettes for storing therein and releasing therefrom a predetermined amount of tablets form an outer periphery of said each drum, wherein the drum rotating means allows the tablet cassettes to be filled with tablets when required, wherein a plurality of tablet release holes are downwardly formed in said each drum by a plurality of tablet release guides to correspondingly communicate with the tablet cassettes for the tablet release; and b) a packaging unit disposed below the tablet dropping unit to package tablets released through the tablet release holes from the tablet dropping unit and discharge packaged tablet bags to an exterior of the automatic tablet dispenser.

7. The automatic tablet dispenser of claim 6, wherein the packaging unit comprises:

a) a discharge hopper for assembling the tablets being dropped from said tablet dropping unit;

b) a heater assembly for packaging the tablets released through the discharge hopper;

c) a printer for printing respective information on a packaging paper; and d) a release conveyer for externally releasing the tablet-packaged bags.

8. The automatic tablet dispenser of claim 6, wherein the drum rotating means comprises:

a) a rotating gear plate fixed on top of said drum bodies;

b) a guide plate fixed beneath said drum bodies;

c) a motor attached to said automatic tablet dispenser adjacent to said gear plate;

d) a driving gear fixedly attached to said motor, said motor rotatably engaged to said gear plate for rotating said gear plate; and e) a plurality of auxiliary gears provided along the periphery of said gear plate.

9. The automatic tablet dispenser of claim 6, wherein the first and second inner drums are respectively arc-shaped.

10. The automatic tablet dispenser of claim 6, wherein the tablet cassettes of the first inner drum are spaced from and faced against those of the second inner drum.

11. The automatic tablet dispenser of claim 9, wherein the first and second arc-shaped inner drums are respectively formed in a linearly aligned pair such that the first drum body is closedly looped by the first arc-shaped outer drum and the first arc-shaped inner drum pair and that the second drum body is closedly looped by the second arc-shaped outer drum and the second arc-shaped inner drum pair.

12. The automatic tablet dispenser of claim 6, wherein a plurality of tablet release openings are formed through the tablet release guides so that the tablets in the tablet cassettes are selectively released through the tablet release openings, wherein a guide plate is formed above said each tablet release opening and correspondingly on said each release guide in a downward slant to prevent tablets being dropped through said release hole from flowing into said tablet release opening.

13. The automatic tablet dispenser of claim 6, wherein the first arc-shaped drum and the first inner drum are joined by at least one bracket to each other, and the second arc-shaped drum and the second inner drum are joined by at least one bracket to each other.

14. A tablet dropping unit for an automatic tablet dispenser, comprising:

a) a first drum body closedly looped by a first arc-shaped outer drum and a first inner drum each incorporating the first drum body;

b) a second drum body closedly looped by a second arc-shaped outer drum and a second inner drum each incorporating the second drum body, wherein a plurality of tablet cassettes for storing therein and releasing therefrom a predetermined amount of tablets form an outer periphery of said each drum, wherein a plurality of tablet release holes are downwardly formed in said each drum by a plurality of tablet release guides to correspondingly communicate with the tablet cassettes for the tablet release;

c) a means for rotating the first and second drum bodies to fill the tablet cassettes with tablets when required.

15. The tablet dropping unit of claim 14, wherein the drum rotating means comprises:

a) a rotating gear plate fixed on top of said drum bodies;

b) a guide plate fixed beneath said drum bodies;

c) a motor attached to said automatic tablet dispenser adjacent to said gear plate;

d) a driving gear fixedly attached to said motor, said motor rotatably engaged to said gear plate for rotating said gear plate; and e) a plurality of auxiliary gears provided along the periphery of said gear plate.

16. The tablet dropping unit of claim 14, wherein the first and second inner drums are respectively arc-shaped.

17. The tablet dropping unit of claim 14, wherein the tablet cassettes of the first inner drum are spaced from and faced against those of the second inner drum.

18. The tablet dropping unit of claim 16, wherein the first and second arc-shaped inner drums are respectively formed in a linearly aligned pair such that the first drum body is closedly looped by the first arc-shaped outer drum and the first arc-shaped inner drum pair and that the second drum body is closedly looped by the second arc-shaped outer drum and the second arc-shaped inner drum pair.

19. The tablet dropping unit of claim 14, wherein a plurality of tablet release openings are formed through the tablet release guides so that the tablets in the tablet cassettes are selectively released through the tablet release openings, wherein a guide plate is formed above said each tablet release opening and correspondingly on said each release guide in a downward slant to prevent tablets being dropped through said release hole from flowing into said tablet release opening.

20. The automatic tablet dispenser of claim 14, wherein the first arc-shaped drum and the first inner drum are joined by at least one bracket to each other, and the second arc-shaped drum and the second inner drum are joined by at least one bracket to each other.

* * * * *